US008523537B2

(12) United States Patent
Garry

(10) Patent No.: US 8,523,537 B2
(45) Date of Patent: Sep. 3, 2013

(54) INTEGRAL PLUS PROPORTIONAL DUAL PUMP SWITCHING SYSTEM

(75) Inventor: Michael P. Garry, Rockford, IL (US)

(73) Assignee: Woodward, Inc., Fort Collins, CO (US)

( * ) Notice: Subject to any disclaimer, the term of this patent is extended or adjusted under 35 U.S.C. 154(b) by 285 days.

(21) Appl. No.: 12/860,971

(22) Filed: Aug. 23, 2010

(65) Prior Publication Data

US 2012/0045348 A1 Feb. 23, 2012

(51) Int. Cl.

| | |
|---|---|
| ***F04B 49/08*** | (2006.01) |
| ***F04B 23/04*** | (2006.01) |
| ***F04B 41/06*** | (2006.01) |
| ***F02M 57/02*** | (2006.01) |

(52) U.S. Cl.
USPC ..... 417/286; 417/308; 417/428; 417/53; 123/446

(58) Field of Classification Search
USPC ..... 417/278, 286, 288, 300, 304, 307, 417/308, 428, 440, 53; 137/111, 112, 565.33; 123/445–447
See application file for complete search history.

(56) References Cited

U.S. PATENT DOCUMENTS

| | | | | |
|---|---|---|---|---|
| 2,835,323 | A | 5/1958 | Booth | |
| 3,953,153 | A | 4/1976 | Huber et al. | |
| 4,102,606 | A | 7/1978 | Huber et al. | |
| 4,245,964 | A | 1/1981 | Rannenberg | |
| 4,591,317 | A * | 5/1986 | Markunas | 417/288 |
| 5,159,808 | A | 11/1992 | Kast | |
| 5,918,573 | A | 7/1999 | Killion | |
| 2008/0289338 | A1 * | 11/2008 | Desai | 60/734 |
| 2011/0162724 | A1 * | 7/2011 | Kleckler | 137/115.23 |

FOREIGN PATENT DOCUMENTS

| | | |
|---|---|---|
| EP | 1 557 546 A1 | 7/2005 |
| EP | 1 662 117 A2 | 5/2006 |

OTHER PUBLICATIONS

U.S. Appl. No. 12/683,685, Kleckler, filed Jan. 7, 2010.

* cited by examiner

*Primary Examiner* — Bryan Lettman
(74) *Attorney, Agent, or Firm* — Reinhart Boerner Van Deuren P.C.

(57) ABSTRACT

A dual-pump fluid distribution system that includes a first pump having an inlet and an outlet, and configured to supply a first flow of fluid, and a second pump having an inlet and an outlet, and configured to supply a second flow of fluid. In an embodiment, a bypass flow valve with a four-way hydraulic bridge is configured to initiate the switch between single-pump mode and dual-pump mode based on fluid flow demand. The bypass flow valve is configured such that the position of the bypass flow valve member relative to the four-way hydraulic bridge operates a pump selector valve. In an embodiment, the pump selector valve has a valve member, a biasing element, and a pressure switching port, and is configured such that the position of the valve member determines whether the second flow of fluid is combined with the first flow of fluid.

13 Claims, 3 Drawing Sheets

INTEGRAL PLUS PROPORTIONAL DUAL PUMP SWITCHING SYSTEM

FIELD OF THE INVENTION

This invention generally relates to fluid distribution systems, and, more particularly, to fluid distribution systems capable of operating in a single-pump mode or in a dual-pump mode.

BACKGROUND OF THE INVENTION

Aircraft turbine engine main fuel pumps are typically high-pressure positive-displacement pumps in which the pump flow rate is proportional to engine speed. At many engine operating conditions the engine flow demand is significantly less than the high amount of flow supplied by the main fuel pump. The excess high-pressure pump flow is typically bypassed back to the low pressure inlet. Raising the pressure of the excess flow and then bypassing it back to low-pressure typically wastes energy. Generally, this wasted energy is converted to heat, which can be potentially useful, results in undesirably high fuel temperatures.

One means for reducing this energy loss is to implement a dual-pump system such that the amount of excess flow raised to high pressure is reduced at key thermal conditions. Systems that use two fuel supplies, for example two positive displacement pumps, can minimize the amount of bypass flow at high pressure differentials. This can be done by separating the two supply flows and only bypassing flow from one pump at a high pressure differential (e.g., the second supply pump would be bypassed at a much lower pressure differential). This reduces the wasted energy (i.e., heat) added to the fuel.

One problem encountered in implementing fuel distribution systems with dual pump supplies is that when the second pump supply is added (or subtracted) to the first pump supply, the system often generates unacceptable flow disturbances, or transients, resulting from the switch between single-supply and dual-supply operating modes.

It would therefore be desirable to have a system and method for dual-supply fuel distribution that reduces the flow disturbances which normally occur during transitions between single-supply and dual-supply operating modes. Embodiments of the invention provide such a system and method. These and other advantages of the invention, as well as additional inventive features, will be apparent from the description of the invention provided herein.

BRIEF SUMMARY OF THE INVENTION

In one aspect, embodiments of the invention provide a dual-pump fluid distribution system that is capable of switching between single-pump mode and dual-pump mode depending on fluid flow demand. In an embodiment, the dual-pump fluid distribution system includes a first pump having an inlet and an outlet, the first pump configured to supply a first flow of fluid, and a second pump having an inlet and an outlet, the second pump configured to supply a second flow of fluid. An embodiment of the fluid distribution system further includes a bypass flow valve having a valve member, a biasing element, and a four-way hydraulic bridge, and the bypass flow valve is configured to initiate the switch between single-pump mode and dual-pump mode based on fluid flow demand. Further, the bypass flow valve is configured such that the position of the bypass flow valve member relative to the four-way hydraulic bridge operates a pump selector valve.

In an embodiment, the pump selector valve has a valve member, a biasing element, and a pressure switching port, and the pump selector valve is configured such that the position of the valve member determines whether the second flow of fluid is combined with the first flow of fluid.

In another aspect, embodiments of the invention provide a method of supplying fluid using a fluid distribution system capable of alternating between single-pump operation and dual-pump-operation. In an embodiment, the method includes the steps of operating the fluid distribution system in single-pump mode when a flow demand can be satisfied using a first pump, and operating the fluid distribution system in dual-pump mode by adding the flow from a second pump to that of the first pump when the flow demand exceeds the capacity of the first pump to meet the flow demand. In an embodiment, the method further includes alternating between single-pump mode and dual-pump mode by sensing the flow demand based on a pressure at the outlet of the first pump, wherein sensing the flow demand based on a pressure at the outlet of the first pump comprises placing a bypass flow valve between first and second pump outlets and a metering valve.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

In the following description, embodiments of the invention are disclosed with respect to their application in a fuel distribution system. However, one having ordinary skill in the art will recognize that embodiments of the invention described herein can be applied to the distribution of a variety of fluids, including but not limited to fuels, where the fluid output supplied by the system is metered. Accordingly, embodiments of the invention include dual-pump systems for the distribution of virtually any fluid that is typically supplied by such a fluid distribution system.

In embodiments of the present invention, a fluid distribution system, such as for the distribution of fuel in an aircraft for example, incorporates a dual-pump switching system which allows the discharge flow from the two pumps to be separated when operating in single-pump mode, and then combined when operating in dual-pump mode. Continuing with this example, when the fuel distribution system is operating in single-pump mode, a first pump supplies all of the high-pressure burn flow to the engine combustor. Other required engine flows can be supplied by either the first pump or a second pump depending on how the fuel distribution system is configured. With the system operating in single-pump mode, the discharge pressure of the first pump is typically set by downstream conditions such as fuel nozzle restriction and combustor pressure.

Moreover, in an embodiment of the invention, when operating in single-pump mode, the second pump discharge pressure can be controlled independently of the first pump discharge pressure. By minimizing the pressure differential across the first and second pumps when the system is operating in single-pump mode, the system operates efficiently in terms of power consumption, and further adds relatively little thermal energy to the fluid circulating in the system. When the flow demand approaches the capacity of the first pump, the second pump pressure is raised above the first pump pressure and a portion of the second pump flow is supplied to supplement the flow from the first pump.

Figure 1:
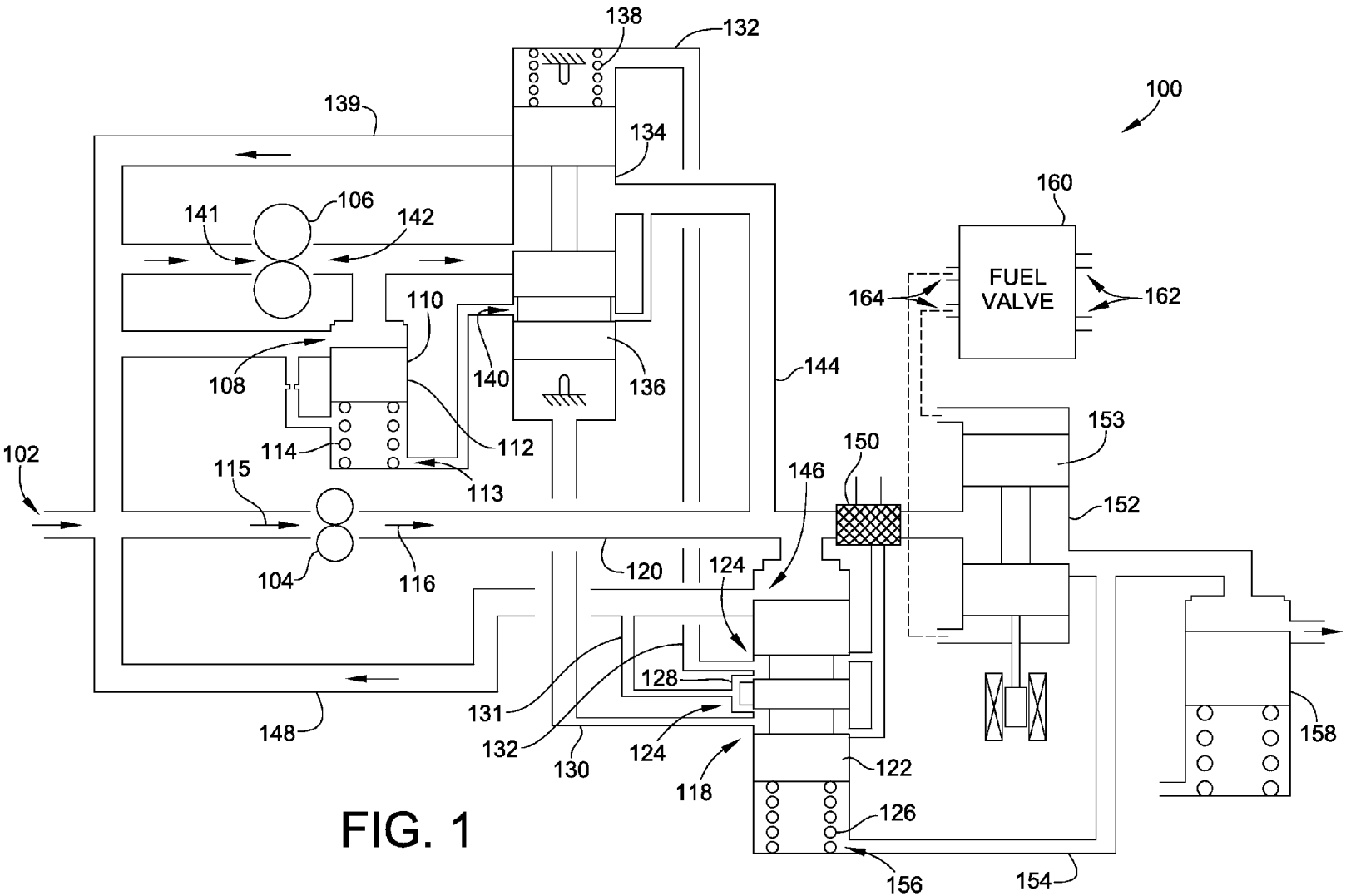
FIG. 1 is a schematic diagram of an embodiment of a fluid distribution system, with dual fixed positive-displacement pumps, constructed in accordance with an embodiment of the present invention.

FIG. 1 is a schematic diagram of an embodiment of a fluid distribution system 100 that includes dual fixed positive-displacement pumps, constructed in accordance with an embodiment of the present invention. Fluid distribution system 100 includes a main inlet 102 through which fuel for example, or in an alternate embodiment some other liquid, flows into the fluid distribution system 100. The main inlet 102 branches off to supply a first pump 104 and a second pump 106. In the embodiment of FIG. 1, both first and second pumps 104, 106 are fixed-positive-displacement pumps, though embodiments are contemplated, and will be shown below, in which another type of pump is used. The main inlet 102 is also coupled to a port 108 of a second pump pressurizing valve 110, which comprises a valve member 112 and a biasing element 114. The first pump 104 has an inlet 115 and an outlet 116. The first pump 104 is coupled to a bypass flow valve 118 (also known as an integral plus proportional bypass valve) via flow line 120.

The bypass flow valve 118 includes a bypass flow valve member 122, a four-way hydraulic bridge 124, and a biasing element 126. The four-way hydraulic bridge 124 includes two ports coupled by a flow line 128, and two remaining ports coupled respectively to two flow lines 130, 132. These flow lines 130, 132 couple the two ports of the four-way hydraulic bridge 124 with two ports at opposite ends of a pump selector valve 134, which comprises a valve member 136, a biasing element 138, and a pressure switching port 140. The four-way hydraulic bridge 124 also includes the bypass flow valve member 122, which has alternating large-diameter and small-diameter portions. The pressure switching port 140 is coupled to a port of the second pump pressurizing valve 110. The pump selector valve 134 is coupled to a bypass line 139 configured to provide a path for the discharge flow from the first pump 104 back to the inlet 115 of the first pump 104 when the pump selector valve member 136 is positioned to allow for flow into the bypass line 139.

The second pump 106 includes inlet 141 and outlet 142, wherein the outlet 142 is coupled to both the second pump pressurizing valve 110 and the pump selector valve 134. An output line 144, configured to accept a flow from the output of the second pump 106 via the pump selector valve 134, is coupled to flow line 120 and thus to the main port 146 of bypass flow valve 118, wherein the bypass flow valve main port 146 is configured to provide fluid communication between the outlets 116, 142 of the first and second pumps 104, 106 and a bypass line 148 configured to direct the flow of liquid from first and second pump outlets 116, 142 back to the first pump inlet 115. An actuation supply unit 150 is coupled between the bypass flow valve 118 and a metering valve 152. The actuation supply unit 150 is configured to supply a flow of pressurized fluid to various devices, such as hydraulic devices, attached to the fluid distribution system 100. A flow line 154 couples the output of the metering valve 152 to a port 156 at one end of the bypass flow valve 118. A pressurizing and shutoff valve 158 is also coupled to the output of the metering valve 152.

In operation, fuel, or in an alternate embodiment some other liquid, flows into the main inlet 102 of fluid distribution system 100 and to the inlets 115, 141 of the first and second pumps 104, 106. The bypass flow valve 118 is configured to sense the pressure differential across the metering valve 152 and to regulate that pressure differential by controlling the amount of total pump (i.e., first and second pump) bypass flow. In at least one embodiment, a fuel valve, for example an electrohydraulic servo valve 160(EHSV) has two inputs 162: one coupled to the main inlet 102 and one coupled to the output flow of the first pump 104, or to the output flow of the first and second pumps 104, 106 when their flows are combined. The EHSV 160 has two outputs 164 corresponding to the two inputs 162. The EHSV outputs 164 are coupled to ports at opposite ends of the metering valve 152. Flows from the EHSV outputs 164 enter the corresponding ports on the metering valve 152 and, depending on the pressure differential in the flow from the EHSV outputs 164, may cause a metering valve member 153 to move toward the port having the lower pressure. As can be seen from FIG. 1, when pressure differential becomes large, the metering valve member 153 is moved in the upward direction (pictorially) reducing the flow through the pressurizing and shutoff valve 158 to the engine (not shown). This increases the pressure on bypass flow valve member 122 at the bypass flow valve main port 146, moving the bypass flow member 122 downward (pictorially) such that the flow through the bypass flow valve main port 146 and through the bypass flow line 148 increases. This increased bypass flow reduces the pressure at the outlet 116, thus reducing the pressure differential seen by the metering valve 152.

The bypass flow valve 118 senses the differential pressure across the metering valve 152 and regulates that pressure differential by controlling the amount of total pump bypass flow. The bypass flow valve main port 146 normally maintains a minimal amount of pump bypass flow. The bypass flow into flow line 131 and into flow line 128 is available for quick response in advance of the slower high gain integral system. The integrating portion of the bypass flow valve 118 consists of a four-way hydraulic bridge 124 to regulate the pressures in flow line 130 and flow line 132 based on the position of the bypass flow valve member 122.

When the fluid distribution system 100 is in equilibrium (i.e., the discharge pressures of first and second pumps 104, 106 are approximately equal), the bypass flow valve member 122 is in a "null position" as shown in FIG. 1. The four-way hydraulic bridge 124 is located such that its null position corresponds to a set amount of proportional port area. As the bypass flow valve member 122 moves from the null position, flow line 130 and flow line 132 pressures change to position (integrate) the pump selector valve 134. Depending on the position of the pump selector valve 134, flow is either added from the second pump 106 to supplement the first pump 104, or no flow is added from second pump 106 and an additional bypass port is opened on the pump selector valve 134 to provide a second path for first pump 104 bypass flow.

Referring to FIG. 1, an excess of pump metered flow causes an increase in pressure from the first pump 104 relative to that of the second pump 106, which causes the bypass flow valve main port 146 area to increase and moves the bypass flow valve member 122 away from its null position in the downward direction (pictorially). The movement of the valve member 122 leads to an increase in flow line 130 pressure and a decrease in flow line 132 pressure and results in an upward movement of the pump selector valve member 136. Depending on the pump selector valve member 136 position, this either increases the amount of flow from the first pump 104 bypassed through the pump selector valve 134, or decreases the amount of flow from the second pump 106 added to supplement flow from the first pump 104. This results in lower metered flow, which returns the bypass flow valve member 122 to its null position.

In the case of too little flow from the first pump 104 to meet engine flow demand, the drop in pressure causes the bypass flow valve main port 146 area to decrease and moves the bypass flow valve member 122 away from its null position in the upward direction (pictorially). The movement of the valve member 122 leads to a decrease in flow line 130 pressure and an increase in flow line 132 pressure and results in a downward movement of the pump selector valve member 136. Depending on the pump selector valve member 136 position, this either decreases the amount of flow from the first pump 104 bypassed through the pump selector valve 134, or increases the amount of flow from the second pump 106 added to supplement flow from the first pump 104. This results in greater metered flow and returns the bypass flow valve member 122 to its null position.

Whether the engine flow demand is greater or lesser than that provided by the fluid distribution 100 at a particular time, the bypass flow valve 118 proportional ports coupled to flow line 128 provide a rapid response to change in metering valve 152 differential pressure. The integrating section, which include those ports coupled to flow lines 130, 132, then responds to bring the bypass flow valve member 122 back to its null position. Since the bypass flow valve member 122 returns to its null position, the steady state bypass port area of the bypass flow valve main port 146 remains nearly constant.

Another feature of the fluid distribution system 100 is the pressure switching port 140 on the pump selector valve 134. The pressure switching port 140 controls the second pump pressurizing valve 110 reference pressure, and therefore second pump 106 discharge pressure as a function of pump selector valve 134 position. The pressure switching port 140 is timed such that the second pump 106 discharge pressure is increased to be at least equal to the first pump 104 discharge pressure prior to opening the flow path from the second pump 106 to the first pump 104. This feature eliminates backflow from first pump 104 to second pump 106 when switching from single-pump operation to dual-pump operation, which is a key source of flow disturbances during switching. Furthermore, when operating in single-pump mode, the pump selector valve 134 operates the pressure switching port 140 to lower the second pump 106 discharge pressure to the minimum required value, thus reducing the amount of work done by the second pump 106.

Additionally, it is a feature of the fluid distribution system 100, and of those fluid distribution systems described below, that an abrupt increase or decrease in the flow demand can be accommodated without the flow disturbance, and the resulting metering problems, that might occur in conventional dual-pump fuel distribution systems due to the operation of the bypass flow valve 118 with its four-way hydraulic bridge 124. The configuration of the bypass flow valve 118 allows for the rapid increase or decrease fluid flow in response to flow demand via control of the pump selector valve 134 and second pump pressurizing valve 110. This type of control typically results in less wasted energy and less heat added to the fluid in the system than in conventional fluid distribution systems.

Figure 2:
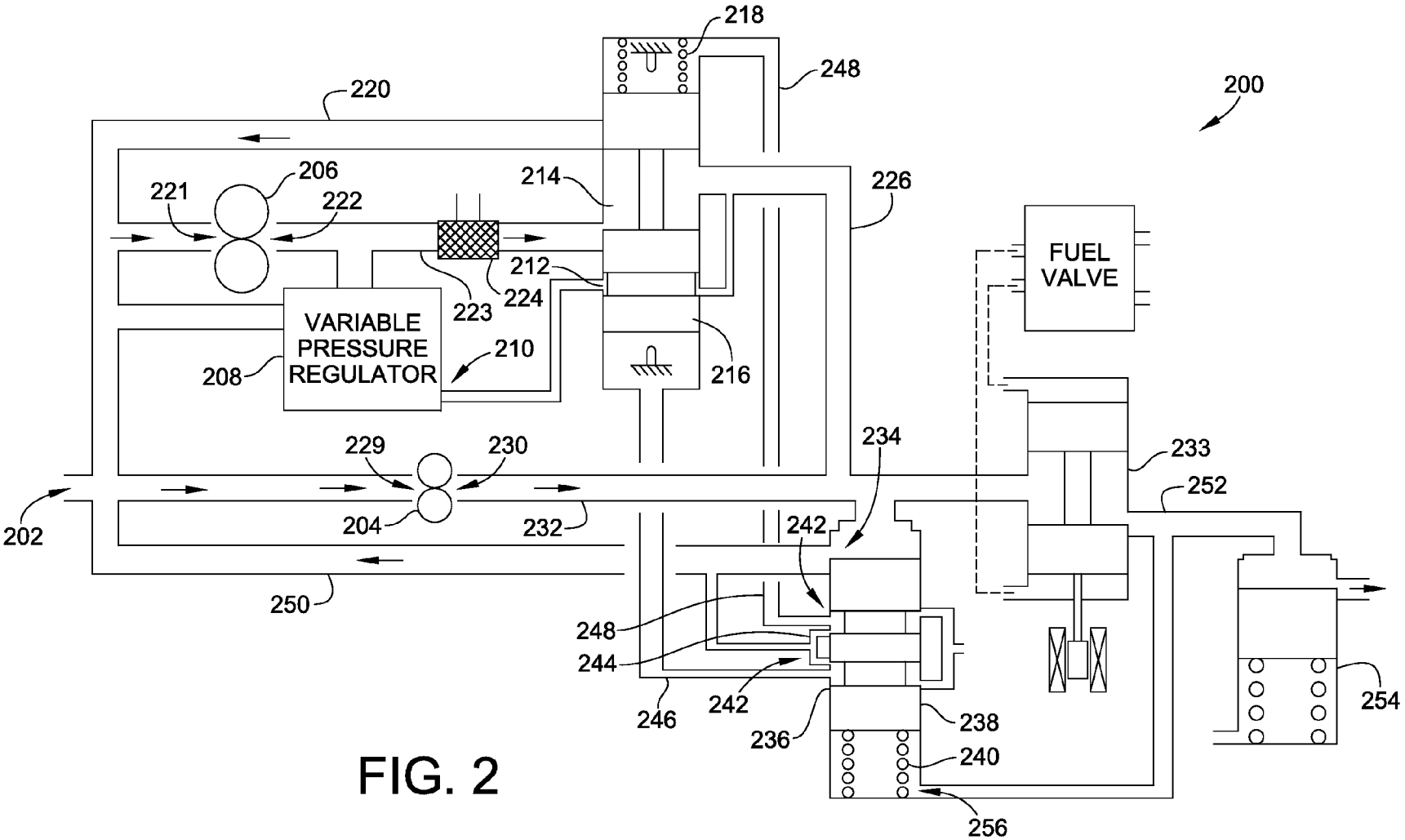
FIG. 2 is a schematic diagram of an embodiment of the fluid distribution system, with dual fixed positive-displacement pumps and variable actuation pressure, constructed in accordance with an embodiment of the present invention.

FIG. 2 is a schematic diagram illustrating an alternate embodiment of a fluid distribution system 200 with variable actuation pressure, constructed in accordance with an embodiment of the invention. Fluid distribution system 200 includes a main inlet 202 through which fuel, or in an alternate embodiment some other liquid, flows into the fluid distribution system 200. The main inlet 202 branches off to supply a first pump 204 and a second pump 206. In the embodiment of FIG. 2, both first and second pumps 204, 206 are fixed-positive-displacement pumps, though embodiments are contemplated in which other types of pumps are used. The main inlet 202 is also coupled to a variable pressure regulator 208, which, in turn, is coupled to an outlet 222 of the second pump 206. The variable pressure regulator 208 includes a port 210 coupled to a pressure switching port 212 of a pump selector valve 214, which comprises a valve member 216 and biasing element 218. The pump selector valve 214 is coupled to a bypass line 220 configured to provide a path for the discharge flow from the first pump 204 back to an inlet 221 of the second pump 206 when the pump selector valve member 216 is positioned to allow for flow into the bypass line 220.

The second pump 206 includes inlet 221 and outlet 222, wherein the outlet 222 discharges into flow line 223, which is coupled to both the variable pressure regulator 208 and an actuation supply unit 224. Flow line 223 is also coupled to pump selector valve 214 such that, depending on the position of pump selector valve member 216, flow output from the second pump 206 can flow through the pump selector valve 214 to flow line 226 to combine with flow from the first pump 204.

First pump 204 has an inlet 229 and an outlet 230, which discharges into flow line 232. Flow line 232 is coupled to flow line 226, to metering valve 233, and to a main port 234 of a bypass flow valve 236 (also known as an integral plus proportional bypass valve), which comprises a valve member 238 and a biasing element 240. The bypass flow valve 236 also includes a four-way hydraulic bridge 242. The four-way hydraulic bridge 242 includes two ports coupled by a flow line 244, and two additional ports coupled, respectively, to flow lines 246, 248. The flow lines 246, 248 couple the two additional ports of four-way hydraulic bridge 242 with two ports at the opposite ends of a pump selector valve 214. The four-way hydraulic bridge 242 also includes the bypass flow valve member 238, which has alternating large-diameter and small-diameter portions. The main bypass flow valve port 234 is configured to provide fluid communication between the outlets 222, 230 of the first and second pumps 204, 206 and a bypass line 250 configured to direct the flow of liquid from first and second pump outlets 222, 230 back to the first pump inlet 221.

Liquid flows into the metering valve 233 from flow line 232 and flows out of the metering valve 233 into flow line 252, which is coupled to a pressurizing and shutoff valve 254, and to a port 256 at one end of the bypass flow valve 236. In an embodiment of the invention in which the fluid distribution system 200 operates as a fuel distribution system aboard an aircraft, for example, the output of the pressurizing and shutoff valve 254 flows to the engine (not shown).

In this fluid distribution system 200, servo and actuation flow for all conditions is supplied to the actuation supply unit 224 by the second pump 206. The actuation supply unit 224 is configured to provide a flow of pressurized fluid to various devices, such as hydraulic devices, coupled to the fluid distribution system 200. The variable pressure regulator 208 is configured to actively control the discharge pressure of the second pump 206 to the minimum pressure required to supply the actuation supply unit 224 demands. Operation of the switching system (i.e., alternating between single-pump mode and dual-pump mode) is very similar to the operation described for the fluid distribution system 100 of FIG. 1. One of the differences in the implementation shown in FIG. 2 is that the pressure switching port 212 on the pump selector valve 214 is configured to provide an override signal to the variable pressure regulator to insure that the second pump 206 discharge pressure is maintained above the first pump 204 discharge pressure when operating in dual-pump mode.

Figure 3:
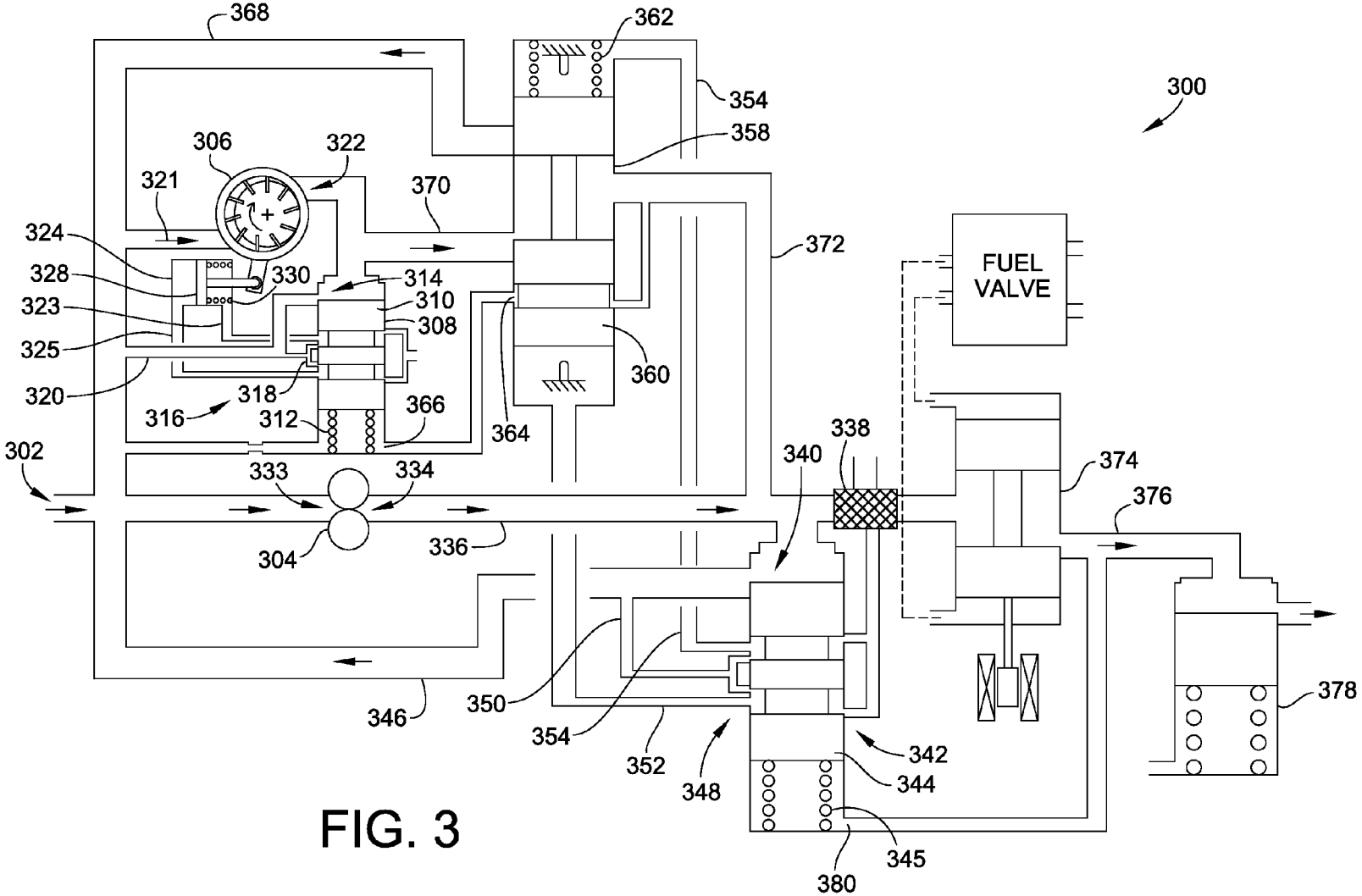
FIG. 3 is a is a schematic diagram of an embodiment of the fluid distribution system, with a fixed positive-displacement pump and a variable positive-displacement pump, constructed in accordance with an embodiment of the present invention.

FIG. 3 is a schematic diagram illustrating yet another embodiment of a fluid distribution system 300, constructed in accordance with an embodiment of the invention. In this embodiment, fluid distribution system 300 has both a fixed-positive-displacement pump and a variable-positive-displacement pump. FIG. 3 shows a first pump 304 having fixed positive displacement, and a second pump 306 having variable positive displacement. In at least one embodiment, fuel, or in an alternate embodiment, some other liquid flows into fluid distribution system 300 at a main inlet 302, which supplies the first and second pumps 304, 306. The main inlet 302 is also coupled to multiple ports on a second pump pressurizing valve 308, which comprises a valve member 310, a biasing element 312, a main port 314, and a four-way hydraulic bridge 316.

The four-way hydraulic bridge 316 includes two ports on the second pump pressurizing valve 308, the two ports coupled by a flow line 318. The flow line 318 is, in turn, coupled to a flow line 320 and configured to accept a bypass flow from the outlet 322 of the second pump 306. Flow line 320 is configured to direct the bypass flow from the outlet 322 of the second pump 306 back to an inlet 321 of the second pump 306. The four-way hydraulic bridge 316 further includes two ports coupled via respective flow lines 323, 325 to ports at opposite ends of a displacement-control valve 324 coupled to the second pump 306. The displacement control valve 324 also includes a piston 328, and a biasing element 330. Further, the four-way hydraulic bridge 316 includes the bypass flow valve member 310, which has alternating large-diameter and small-diameter portions.

The first pump 304 has an inlet 333 and an outlet 334 which discharges into flow line 336 which is coupled to an actuation supply unit 338 and to a main port 340 of a bypass flow valve 342 (also known as an integral plus proportional bypass valve). The actuation supply unit 338 is configured to supply a pressurized fluid flow to various devices, such as hydraulic devices, coupled to the fluid distribution system 300. The bypass flow valve 342 comprises a valve member 344, a biasing element 345, and a four-way hydraulic bridge 348. The bypass flow valve main port 340 provides fluid communication between the outlet 334 of the first pump 304, and a bypass line 346 configured to direct the bypass flow from the outlet 334 of the first pump 304 back to the inlet 333 of the first pump 304. Bypass flow line 346 is coupled to two ports of the four-way hydraulic bridge 348 via flow line 350. The other two ports of the four-way hydraulic bridge 348 are coupled, via flow lines 352, 354 to ports at opposite ends of a pump selector valve 358, which comprises a valve member 360, a biasing element 362, and a pressure switching port 364 coupled to a port 366 at one end of the second pump pressurizing valve 308. The four-way hydraulic bridge 348 also includes the bypass flow valve member 344, which has alternating large-diameter and small-diameter portions. The pump selector valve 358 is coupled to a bypass line 368 configured provide a path for the discharge flow from the first pump 304 back to an inlet 321 of the second pump 306 when the pump selector valve member 360 is positioned to allow for flow into the bypass line 368.

The second pump outlet 322 discharges into flow line 370 which directs the flow from the second pump 306 through the pump selector valve 358 (depending on the position of valve member 360) to flow line 372 which is coupled to flow line 336 allowing for the combination of output flows from the first and second pumps 304, 306. Actuation supply unit 338 is disposed between flow lines 336, 372 and a metering valve 374. Liquid flows into the metering valve 374 from flow lines 336, 372 and flows out of the metering valve 374 into flow line 376, which is coupled to a pressurizing and shutoff valve 378, and to a port 380 at one end of the bypass flow valve 342. In an embodiment of the invention in which the fluid distribution system 300 operates as a fuel distribution system aboard an aircraft, for example, the output of the pressurizing and shutoff valve 378 flows to the engine (not shown).

Operation of the fluid distribution system 300 is very similar to the operation of fluid distribution system 100, described for FIG. 1. One of the differences is that, along with the second pump 306 discharge pressure, the displacement of the second pump 306 can be varied as well. In single-pump mode, first pump 304 supplies all engine flow demand. The pressure switching port 364 on the pump selector valve 358 is configured to minimize the discharge pressure at the outlet 322 of the second pump 306. In addition, the second pump pressurizing valve 308 is configured to regulate the displacement of the second pump 306 such that minimal second pump 306 flow is generated.

When the engine flow demand approaches the capacity of first pump 304, the bypass flow valve 342 operates to raise the second pump 306 pressure above the first pump 304 pressure, such that a portion of the second pump 306 flow is supplied to supplement the first pump 304 flow. The four-way hydraulic bridge 316 on the second pump pressurizing valve 308 controls the displacement of second pump 306 to supplement the flow from the first pump 304 when necessary, and to maintain a minimal amount of bypass flow through the second pump pressurizing valve 308.

As stated above, embodiments of the fuel distribution system described herein may be used in the distribution of fluids other than those used as fuel. One of ordinary skill in the art will recognize that embodiments of the invention may encompass uses in a variety of fluid distribution systems. However, that said, one of ordinary skill in the art will also recognize that embodiments of the invention are well-suited to aircraft fuel distribution systems where the efficiencies provided by the aforementioned embodiments may result in systems that are lighter and less costly than conventional aircraft fuel distribution systems. Further, aircraft fuel distribution systems incorporating an embodiment of the invention may be more thermally efficient than conventional fuel distribution systems, in which case, the need for cooling systems is greatly reduced, resulting in additional weight and cost savings.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A dual-pump fluid distribution system capable of switching between a single-pump mode and a dual-pump mode depending on a fluid flow demand, the dual-pump fluid distribution system comprising:

a first pump having an inlet and an outlet, the first pump configured to supply a first flow of fluid;

a second pump having an inlet and an outlet, the second pump configured to supply a second flow of fluid; and a bypass flow valve having a valve member, a biasing element, and a four-way hydraulic bridge, the bypass flow valve configured to initiate the switch between single-pump mode and the dual-pump mode based on the fluid flow demand;

wherein the bypass flow valve is configured such that a position of the bypass flow valve member relative to the four-way hydraulic bridge operates a pump selector valve; and wherein the pump selector valve has a valve member, a biasing element, and a pressure switching port, the pump selector valve configured such that a position of the pump selector valve member determines whether the second flow of fluid is combined with the first flow of fluid, and further comprising:

a variable pressure regulator that includes a first port coupled to the second pump outlet, a second port coupled to the second pump inlet, and a third port directly coupled to the pump selector valve pressure switching port, and a actuation supply unit disposed between the second pump outlet and the pump selector valve, the actuation supply unit configured to provide a pressurized flow of fluid.

2. The dual-pump fluid distribution system of claim 1, further comprising a metering valve configured to sense a pressure differential between the first pump inlet and the first pump outlet, and further configured to maintain the pressure differential within a desired range.

3. The dual-pump fluid distribution system of claim 1, wherein a metering valve is configured to regulate a pressure differential between the first and second pump inlets and the first and second pump outlets by controlling a fluid flow through the metering valve, and by controlling a bypass flow from the first pump outlet through the bypass flow valve back to the first pump inlet.

4. The dual-pump fluid distribution system of claim 1, wherein the four-way hydraulic bridge comprises:

a first port in the bypass flow valve coupled, via a first flow line, to a first port at a first end of the pump selector valve;

a second port in the bypass flow valve coupled, via a second flow line, to a second port at a second end of the pump selector valve, the second end opposite the first end;

a third port in the bypass flow valve coupled, via a third flow line, to a fourth port in the bypass flow valve;

wherein the bypass flow valve member is configured to block one of the first and second ports to regulate an outlet pressure of the second pump.

5. The dual-pump fluid distribution system of claim 1, wherein the pressure switching port is configured to provide an override signal to the variable pressure regulator to maintain an outlet pressure for the second pump above an outlet pressure for the first pump.

6. The dual-pump fluid distribution system of claim 1, wherein the fluid distribution system is configured as a fuel distribution system aboard an aircraft.

7. The dual-pump fluid distribution system of claim 1, wherein the first and second pumps comprise fixed-positive displacement pumps.

8. The dual-pump fluid distribution system of claim 1, wherein the biasing elements are coil springs.

9. A method of supplying fluid using a fluid distribution system capable of alternating between a single-pump operation and a dual-pump-operation, the method comprising the steps of:

operating the fluid distribution system in a single-pump mode when a flow demand can be satisfied using a first pump;

operating the fluid distribution system in a dual-pump mode by adding a flow from a second pump to a flow of the first pump when the flow demand exceeds a capacity of the first pump to meet the flow demand;

alternating between the single-pump mode and the dual-pump mode by sensing the flow demand based on a pressure at an outlet of the first pump, wherein sensing the flow demand based on the pressure at the outlet of the first pump comprises placing a bypass flow valve between the first pump outlet and a second pump outlet and a metering valve, wherein alternating between the single-pump mode and the dual-pump mode by sensing the flow demand based on the pressure at the outlet of the first pump further comprises providing the bypass flow valve with a four-way hydraulic bridge such that the bypass flow valve is configured to operate a pump selector valve to regulate an outlet pressure of the second pump, wherein operating the fluid distribution system comprises operating the fluid distribution system wherein an actuation supply unit is coupled between the second pump outlet and the pump selector valve, and wherein operating the fluid distribution system in the single-pump mode comprises positioning a pump selector valve member in the pump selector valve such that a flow path from the second pump outlet to the first pump outlet is directly blocked by the pump selector valve member, and wherein operating the fluid distribution system in the dual-pump mode comprises positioning the pump selector valve member such that the flow path from the second pump outlet to the first pump outlet is not blocked by the pump selector valve member.

10. The method of claim 9, further comprising configuring the metering valve to sense a pressure differential between a first pump inlet and the first pump outlet, and to control a flow rate out of the metering valve to maintain the pressure differential within a desired range.

11. The method of claim 9, wherein operating the fluid distribution system in the dual-pump mode comprises operating the fluid distribution system wherein the first and second pumps are fixed-positive displacement pumps.

12. The method of claim 11, wherein operating the fluid distribution system in the dual-pump mode further comprises providing a variable pressure regulator on a bypass line from the second pump outlet to a second pump inlet, wherein the variable pressure regulator is configured to control an outlet pressure of the second pump to maintain a minimum pressure required to meet the flow demand.

13. The method of claim 9, further comprising providing the actuation supply unit to provide pressurized fluid to a hydraulic device.

* * * * *